United States Patent [19]

Hein et al.

[11] 4,256,168

[45] Mar. 17, 1981

[54] COOLING SPRAY NOZZLE ADJUSTING ARRANGEMENT PARTICULARLY FOR STEEL STRAND CASTING PLANTS

[75] Inventors: Karl Hein, Duisburg; Dieter Kothe, Moers, both of Fed. Rep. of Germany

[73] Assignee: DEMAG, Aktiengesellschaft, Fed. Rep. of Germany

[21] Appl. No.: 51,951

[22] Filed: Jun. 25, 1979

Related U.S. Application Data

[63] Continuation-in-part of Ser. No. 822,532, Aug. 8, 1977, abandoned.

[30] Foreign Application Priority Data

Aug. 14, 1976 [DE] Fed. Rep. of Germany ..... 2636666

[51] Int. Cl.[3] ..... B22D 11/124

[52] U.S. Cl. ..... 164/444; 72/201; 134/122 R; 134/122 P; 134/180; 164/89; 239/165; 239/166

[58] Field of Search ..... 134/64 R, 64 P, 122 R, 134/122 P, 172, 180; 164/444, 89, 414; 239/165, 166, 587; 118/314, 315, 323; 72/201; 266/113, 114, 259; 425/404, 445

[56] References Cited

U.S. PATENT DOCUMENTS

| | | | |
|---|---|---|---|
| 1,910,674 | 5/1933 | Bramsen et al. | 266/113 X |
| 3,289,449 | 12/1966 | O'Brien | 266/113 X |
| 3,561,398 | 2/1971 | Rose et al. | 118/323 X |
| 3,935,896 | 2/1976 | Tegtmeier et al. | 164/89 |
| 4,031,946 | 6/1977 | Marti et al. | 164/89 |

FOREIGN PATENT DOCUMENTS

| | | | |
|---|---|---|---|
| 2401263 | 7/1975 | Fed. Rep. of Germany | 164/444 |

*Primary Examiner*—Robert D. Baldwin
*Assistant Examiner*—Gus T. Hampilos
*Attorney, Agent, or Firm*—Mandeville and Schweitzer

[57] ABSTRACT

The invention refers to a spray nozzle arrangement for metal strand casting plants, particularly steel strand casting plants with several nozzles on one spray plane, such nozzles being adjustable with respect to the distance from the casting strand, and with each other in parallel direction; they are also adjustable at right angle with the course of direction of the strand by means of parallel adjusting devices. Adjustment of the spray nozzles serves the purpose to either control the cooling intensity via the impact energy, or to adapt the spray angle of a certain spray nozzle to a change in strand width. Both steps may be used in combination for the adjustment required.

5 Claims, 3 Drawing Figures

COOLING SPRAY NOZZLE ADJUSTING ARRANGEMENT PARTICULARLY FOR STEEL STRAND CASTING PLANTS

BACKGROUND OF THE INVENTION

This is a continuation-in-part application of U.S. Application Ser. No. 822,532, filed Aug. 8, 1977, now abandoned.

It is known (German disclosure 25 07 971) to adapt cooling to changes in size, in steel analysis, or different spray angles by adjusting the distance between two neighboring nozzles and their distance from the strand surface. In known fashion, a parallelogram positioning mechanism is used for adjustment. This mechanism is designed so that joints arranged along a straight line parallel with the strand surface serve as attachments for spray nozzle tubes. To this end, the exterior link rods rest in a joint in the strand center axis. The exterior link rods also move in an umbrella-like fashion. Because of this, all nozzles go through the adjusting motions simultaneously. This mechanism has the disadvantage that the motions necessary for bringing the nozzles closer to the strand and making parallel adjustments amongst the nozzles, are limited to the fixed structural dimensions of such mechanism. Movement of one nozzle requires movement of them all, and thus there is limitation as to flexibility of adjustment.

STATEMENT OF THE INVENTION

In contrast with the known solution, the present invention eliminates the interdependence between the nozzles guided by parallelogram adjusting devices, and furthermore, provides a device for adjusting the spray nozzles which is suitable for extreme widths in casting strands. Such widths may have dimensions of 2600 mm. and more, for example. It is also the object of the invention to cover dimensions of so-called twin strands, i.e. cast strands emerging simultaneously from strand casting molds arranged side by side and spaced at a distance of 300 mm., for example.

The invention provides several separate mounts for each nozzle, and coordinates each mount with a parallelogram adjusting linkage. The advatages of the invention are the independent adjustment of individual nozzles, subsequent addition of supplementary mounts, and independent determination of distances between mounts, while keeping the demand for equipment parts relatively small. These advantages result in metallurgic improvements in that if stronger cooling is desired in zones of greater available heat, it can be achieved by approaching the casting strand in the selected zones by overlapping the spray jets.

The additional spray nozzles are also useful for extremely wide slabs. Twin strands, too, may be covered by spray nozzles arranged apart accordingly. Starting from the strand center of extremely wide casting strands, or from the center between two twin casting strands, the adjustment area of the adjustment linkage is preferably arranged in pairs symmetrically with the strand center axis and positioned on that side of the mounts which extends away from the strand center axis and from each other. By doing so, a favorable use of the impact energy of the spray jets is achieved.

In accordance with the principle of a single parallelogram adjusting linkage for each nozzle, provision is also made that at least one adjusting device at each mount is connected with an apparatus for positioning the adjusting device. Also, the adjustment of lateral distances between nozzles, in addition to lateral movement of the spray nozzles resulting from the parallelogram adjusting linkage, can be provided in such a manner that the mounts are connected with an apparatus for shifting them at right angles to the strand direction.

Adjusting and/or shifting of the spray nozzles is done from outside the support roller stand of the strand casting apparatus by means of the mentioned device for positioning the parallelogram linkage, such device consisting of a threaded nut axially displaceable on a threaded spindle, and attached to one of the adjusting devices. The spindle is positioned at right angles to the strand direction. The apparatus for shifting the mounts consists of a threaded spindle arranged vertically with the strand surface, a threaded nut being axially displaceable on such threaded spindle, with connecting rods being hinged on the mounts and on the threaded nut.

DETAILED DESCRIPTION OF THE INVENTION

Figure 1:
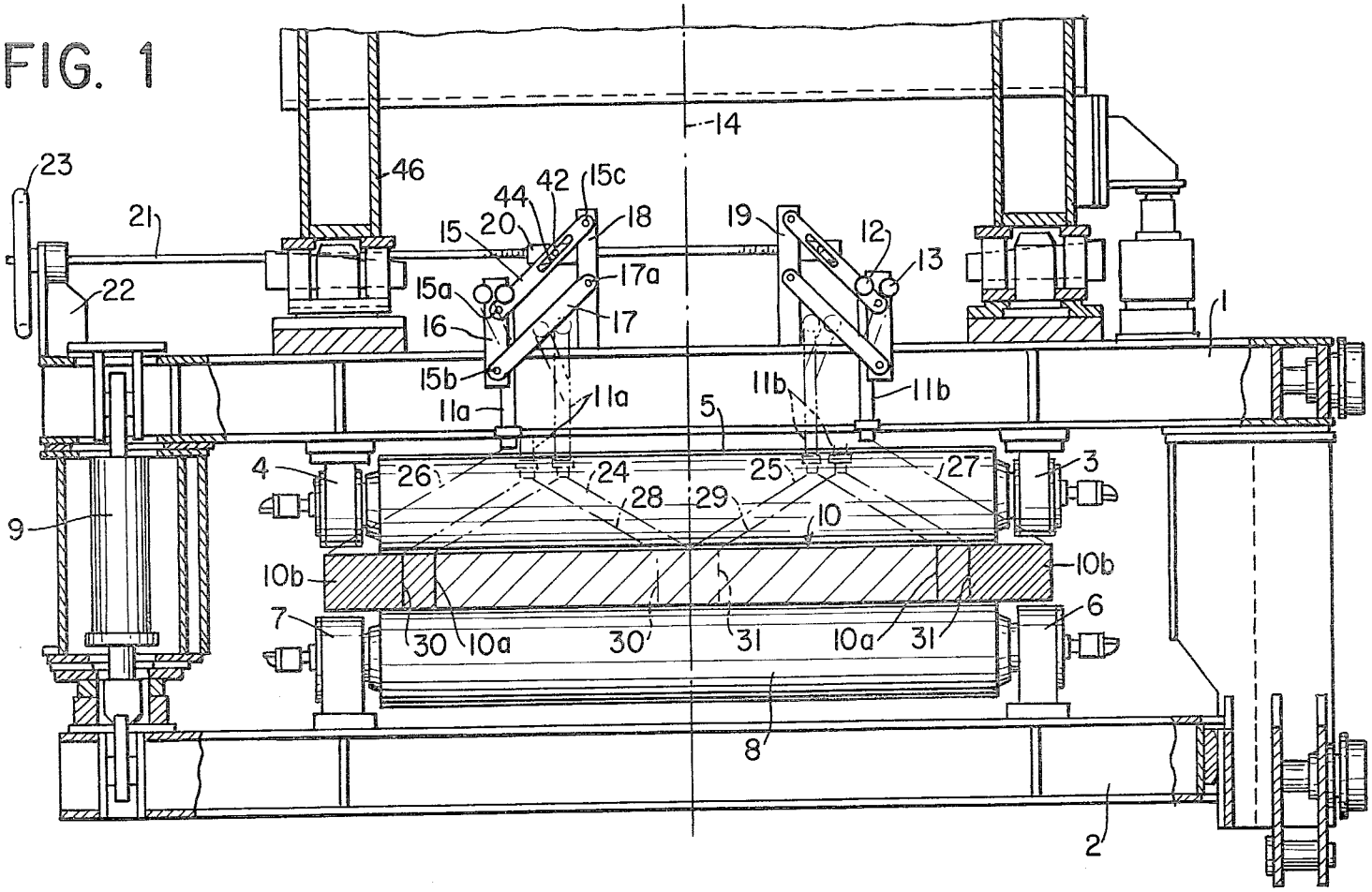
FIG. 1 is a vertical cross section of the support roller stand of a steel strand casting plant, and illustrating schematically aspects of the invention.

In the steel strand casting plant shown, the spray nozzles for water or water mixed with compressed air are located between the support rollers. Rotary bearings 3, 4 for support roller 5 are attached to frame part 1 and rotary bearings 6 and 7 for support roller 8 are attached to frame part 2. The spacing between frame parts 1 and 2 may be adjusted, as by reversible cylinder 9, in order to regulate the thickness of the respective casting strand 10 between support rollers 5 and 8. The spray nozzle arrangement according to the invention is supported on frame part 1 which carries out the adjusting motions between parts 1 and 2. This adjusting motion is superimposed on the adjusting motions for the spray nozzles yet to be described.

In the example shown, there are a number of paired spray nozzles 11*a* and 11*b*. For very wide casting strands, however, several pairs of spray nozzles, as mentioned previously, or a row of individual spray nozzles may be provided. Each of the nozzles 11*a* and/or 11*b* is connected to cooling medium conduits 12 and 13 (merely suggested for reasons of clarity in the drawings).

Figure 3:
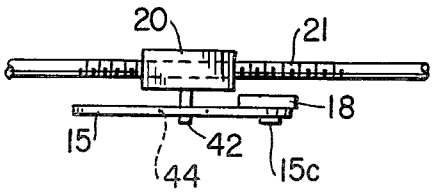
FIG. 3 is a top plan view of a portion of the positioning apparatus of FIG. 1.

Spray nozzles 11*a* and 11*b* are arranged symmetrically with the strand center axis 14. The symmetric position refers to the nozzle opening. Spray nozzles 11*a* and 11*b* are attached to parallelogram linkage 15, 16, 17 by means of joints 15*a*, 15*b*. One side of the parallelogram is formed by mount 18, and the other by 19. They are connected with frame part 1 and support adjusting rods 15 and 17 via joints 15*c* and 17*a*. Adjusting rod 15 is connected to threaded nut 20 via connecting pin 42. Nut 20 cannot carry out any rotary motion. Threaded spindle 21, on the other hand, rotates in bearing 22 attached to frame part 1. When actuating manual wheel 23, threaded spindle 21 rotates so that threaded nut 20 moves parallelogram linkage 15, 16, 17 by pin 42 moving in slot 44 in rod 15, as shown in FIGS. 1 and 3.

FIG. 1 shows three positions of the spray nozzles. The spray jets 24 and 25 coming from spray nozzles 11*a* and 11*b* cool a slab casting strand of the width 10*a*/10*a*. Alternatively, spray jets 26 and 27 coming from these spray nozzles 11*a*, 11*b* cool a slab casting strand of the width 10*b*/10*b* in the indicated position of parallelogram linkage 15, 16, 17. In another case of different casting strand cross section, the spray jets 28, 29 coming from the same spray nozzles 11*a*, 11*b* cool twin strands 30 and 31.

Figure 2:
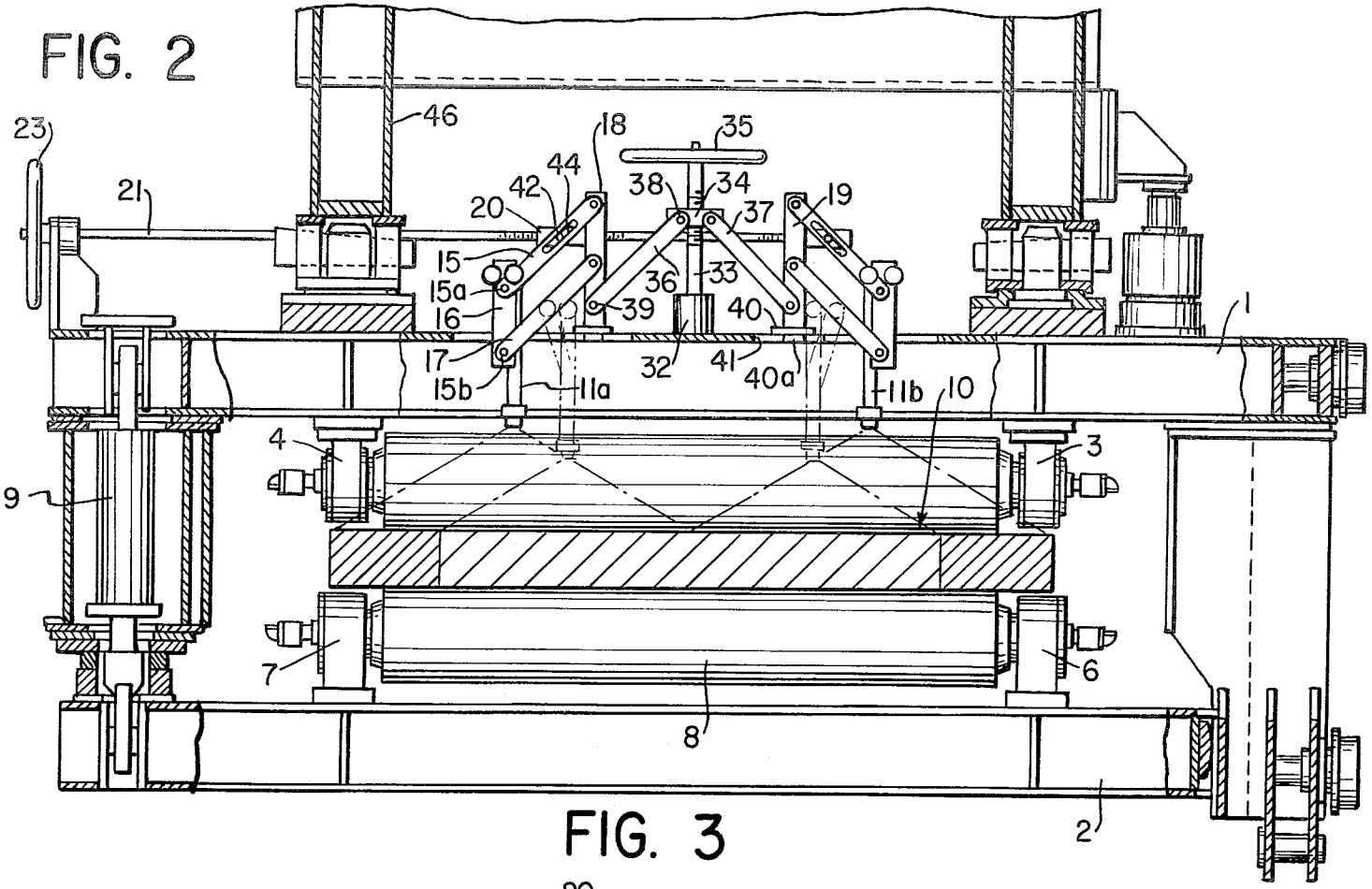
FIG. 2 is the same view as in FIG. 1 but illustrating schematically additional water nozzle adjustment features of the invention.

The arrangement according to FIG. 1, as mentioned, remains unchanged in the example of FIG. 2. For the adjustment of mounts 18 and 19, bearing 32 for threaded spindle 33 has been added (FIG. 2) on frame part 1. The threaded spindle is not axially displaceable, but rotates in bearing 32. Threaded nut 34 moves on threaded spindle 33 when manual wheel 35 moves the threaded spindle. Rods 36 and 37 act as toggle levers and connect, via joints 38 and 39, threaded nut 34 with mounts 18 and/or 19, and shift the latter to the left or to the right. Mounts 18 and/or 19 bear guide plates 40 and slide with projections 40*a* in guide slots 41 at right angles to the strand direction.

The present invention is not limited to the symmetric arrangement referring to the strand of a strand casting apparatus, but permits variations with spray nozzles 11*a* and/or 11*b* which produce a flat jet or a conical jet, and which jets may be arranged to be superimposed upon each other within the spraying plane, depending upon the cooling intensity required.

We claim:

1. In a metal strand casting plant provided with means to guide the cast strand along a path of travel defined as a strand path and spray nozzles positioned along said strand path for subjecting the cast strand to secondary spray cooling, an improved spray nozzle apparatus comprising:

(a) a support for traversing the strand path;

(b) a plurality of nozzles associated with said support and arranged for movement in a spray nozzle plane transverse to the strand path;

(c) a separate mount on said support for carrying each spray nozzle;

(d) a separate parallelogram adjusting linkage mounted on each mount and carrying one of said plurality of spray nozzles;

(e) first means on said support for adjusting the distance of said plurality of spray nozzles in said spray nozzle plane in a first direction toward or away from the strand path;

(f) second means on said support for adjusting the spacing between said plurality of spray nozzles in said spray nozzle plane in a second direction perpendicular to said first direction;

(g) said parallelogram linkage superimposing displacement of said spray nozzles in said first and second directions in response to adjustments by said first and second adjustment means, respectively.

2. The apparatus of claim 1, further characterized by (a) said nozzles and their associated mounts positioned in pairs symmetrically in said spray nozzle plane; and (b) the said parallelogram linkage for each nozzle of each pair extending away from each other in said plane.

3. The apparatus of claim 1, further characterized by (a) third adjusting means on said support for moving said support and the said mounts thereon toward and away from the strand path.

4. The apparatus of claim 1, further characterized by said second adjusting means comprising (a) a threaded nut connected to each pair of parallelogram linkages;

(b) a threaded spindle engaging said threaded nuts; and (c) means on said spindle for the rotation thereof.

5. The apparatus of claim 2, further characterized by (a) a vertically positioned threaded spindle on said support;

(b) a threaded nut axially displaceable on said spindle; and (c) a connecting link pivotally connecting each of said symmetrically arranged mounts to said threaded nut; and (d) said mounts being horizontally movable on said support.

* * * * *